US006735907B2

(12) United States Patent
Stevens

(10) Patent No.: US 6,735,907 B2
(45) Date of Patent: May 18, 2004

(54) ROOF GUTTER COVER SYSTEM AND METHOD

(76) Inventor: Larry Stevens, 3398 Sanford Dr., Marietta, GA (US) 30066

( * ) Notice: Subject to any disclaimer, the term of this patent is extended or adjusted under 35 U.S.C. 154(b) by 0 days.

(21) Appl. No.: 09/987,423

(22) Filed: Nov. 14, 2001

(65) Prior Publication Data

US 2003/0089046 A1 May 15, 2003

(51) Int. Cl.[7] ..... E04D 13/068

(52) U.S. Cl. ..... 52/12; 52/712; 52/98; 52/741.3

(58) Field of Search ..... 52/12, 712, 715, 52/98, 741.3; 248/48.1, 48.2; 210/474; 403/326, 329, 315, 316, 317; 24/458

(56) References Cited

U.S. PATENT DOCUMENTS

| | | | | | |
|---|---|---|---|---|---|
| 2,187,869 | A | * | 1/1940 | Tobin | 248/48.1 |
| 2,889,016 | A | * | 6/1959 | Warren | 52/98 |
| 3,067,881 | A | | 12/1962 | Goosmann | |
| 3,351,206 | A | * | 11/1967 | Wennerstrom | 210/474 |
| 4,404,775 | A | | 9/1983 | Demartini | |
| 4,447,994 | A | | 5/1984 | Garneau | |
| 4,455,791 | A | | 6/1984 | Elko et al. | |
| 4,750,300 | A | * | 6/1988 | Winger, Jr. | 52/12 |
| 4,796,390 | A | * | 1/1989 | Demartini | 52/12 |
| 4,936,612 | A | * | 6/1990 | Kohn | 292/327 |
| 5,181,350 | A | | 1/1993 | Meckstroth | |
| 5,375,379 | A | | 12/1994 | Meckstroth | |
| 5,459,965 | A | | 10/1995 | Meckstroth | |
| 5,495,694 | A | | 3/1996 | Kuhns | |
| 5,557,891 | A | | 9/1996 | Albracht | |
| 5,636,819 | A | * | 6/1997 | Kettlestrings | 248/216.1 |
| 5,660,001 | A | | 8/1997 | Albracht | |
| 5,819,476 | A | | 10/1998 | Annestedt, Sr. | |
| 5,966,875 | A | | 10/1999 | Kuhns | |
| 6,016,631 | A | * | 1/2000 | Lowrie, III | 52/12 |
| 6,098,344 | A | | 8/2000 | Albracht | |
| 6,098,345 | A | | 8/2000 | Demartini et al. | |
| 6,161,338 | A | | 12/2000 | Kuhns | |
| 6,205,715 | B1 | * | 3/2001 | Rex, Jr. | 52/12 |
| 6,269,592 | B1 | | 8/2001 | Rutter | |
| 2002/0069594 | A1 | * | 6/2002 | Sweet | 52/12 |

* cited by examiner

*Primary Examiner*—Brian E. Glessner
(74) *Attorney, Agent, or Firm*—Fleshner & Kim, LLP

(57) ABSTRACT

A rain gutter cover is held in place above a rain gutter by a mounting clip. The cover is a sheet of water impervious material with a curved edge. The mounting clip is configured to receive and compress the curved edge of the rain gutter cover, and can be attached to a variety of rain gutter types with fasteners. The mounting clip is configured to be easily adapted to mount to a variety of rain gutter styles.

24 Claims, 12 Drawing Sheets

ROOF GUTTER COVER SYSTEM AND METHOD

BACKGROUND OF THE INVENTION

1. Field of the Invention

The present invention relates to covers, and more particularly to covers for rain gutters.

2. Background of the Related Art

Rain water running off the roof of a building during a rainstorm can collect and be concentrated along the edge of the building's foundation. Such pooling of run-off water can lead to structural damage to the building by undermining the foundation, flooding parts of the building, etc. To minimize water damage caused by rain water run-off, rain gutters are commonly installed along the periphery of a building's roof to collect and re-direct the water away from the building. However, due to their open structure these gutters tend to collect debris, which obstructs the passageways of the gutter system. With the passageways obstructed, the gutter system cannot carry away the run-off-water. The gutters then overflow and the water once again can cause structural damage.

Simply covering the rain gutter with a cover configured to catch debris, such as a screen, is not a satisfactory solution. When debris gets caught in or above such a cover, the debris begins to back up and collect on the roof. Any cover that allows such a back-up is ineffective since debris always starts to collect at the roof's lowest edge, and usually includes collecting in the gutters. A back-up or dam of debris can cause roof damage by causing water to pool on the roof, as well as detract from the beauty of the home.

Various types of gutter covers or shields have been proposed to prevent the entry of debris into the gutter system. These gutter covers typically are sheets of planar, water impervious material which runs the length of the gutter. One end of the cover is slipped under the edge of the roof covering material, such as the shingles. The other end of the gutter cover terminates in a downward curl, with the outer edge of the curl extending to a region approximately above the outer edge of the gutter. This outer curled edge of the gutter cover is then supported by structural elements that connect the curled edge of the cover to the outer edge of the gutter. These covers can prevent debris from entering the gutter system by directing debris past the gutter's opening. By preventing a build-up of debris, pooling of rain water is minimized and gutter maintenance is reduced.

One example of the curled-edge type of gutter cover is disclosed in U.S. Pat. No. 6,269,592 to Rutter. One embodiment of the Rutter gutter cover is shown in FIG. 2 of that patent. The cover consists of a gutter shield 4 with a curled edge 8, and a mounting clip 9 which is attached to a gutter 1.

As shown in FIG. 3 of Rutter, the mounting clip 9 is a flat piece of elongated metal bent into three sections. The first section is the gutter mounting tab 16 which engages the gutter ledge 3. The middle section is a downward leg 18, and the third section is a riser leg 19 configured to be affixed to the curl 8 of the gutter shield 4.

FIG. 1 of Rutter shows the gutter shield 4 installed where an interior end 5 of the gutter shield 4 is slid under a roofing shingle 6 and above the roofing felt 12. The exterior edge 7 of the gutter shield 4 terminates in the curl 8, which is located in the vicinity of the ledge 3 of the gutter 1. In FIG. 2, the mounting clip 9 is shown with the riser leg 19 attached to the curl 8 and the attached to the ledge 3. The mounting clip 9 holds the exterior edge 7 of the gutter shield 4 in place relative to the gutter 1.

During a rainstorm, water and debris such as leaves wash down the shingles 6 and onto the gutter shield 4. The debris wash over the exterior edge 7 of the gutter shield 4 and past the ledge 3 of the gutter 1, while the water follows the surface of the curl 8 due to the water's surface tension/adhesion and falls into the gutter 1. Thus, the gutter shield 4 serves to prevent debris from collecting in the gutter 1 while still allowing the gutter 1 to collect and carry away run-off water. The mounting clip is necessary to ensure that the curled edge of the cover remains about the gutter to allow water to follow the curve of the cover and pass into the gutter.

The mounting clip used in the Rutter system is quite difficult to install because it must be attached to both the cover and gutter by a fastner. Also, the mounting clip is intended to be attached to the inner curled portion of the cover, which is quite difficult to access once the cover has been placed over the gutter.

Another example of a rain gutter cover is found in U.S. Pat. No. 4,455,791 to Elko et al. (hereinafter "Elko"). The Elko rain gutter cover shown in FIG. 1 has a cover 32 with a curl 33 at its outer edge 36, and an inner edge 38 which is slid under the shingles 16 and 17 and above the roofing felt 15 of the roof 14. The curl 33 is supported in the region of the innermost edge 26 of the front wall 20 of the gutter 19.

Support for the curled 33 edge of the Elko rain gutter cover is for example, by a clip 60, as shown in FIG. 7. The clip 60 has a pair of jaws 61 and 62 to engage the curl 33 of the cover 32. Opposite of the jaws 61 and 62 are jaws 63 and 64 configured to engage the inwardly turned lip 25 of the gutter 19. The outer end 66 of jaw 64 engages the vertical portion 24 relatively far from the inwardly turned lip 25 to stabilize the clip 60 and prevent it from rotating counter-clockwise as viewed in FIG. 7.

Because the clip used in the Elko system is not securely attached to either the gutter or the cover, it can become dislodged during stormy or windy weather.

In operation, the Elko cover 32 functions in a manner similar to Rutter, in that the cover 32 directs rain and debris along its surface towards the curl 33 whereby the debris are directed over the outer edge of the gutter 19, and water is directed along the surface of the curl 33 by surface tension/adhesion to fall into the gutter 19 and be carried away by the gutter system.

The above references are incorporated by reference herein where appropriate for teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a rain gutter cover which directs water into the gutter while directing debris away from the gutter.

Another object of the present invention is to provide a rain gutter cover where water which drips from the cover's rounded edge will not drop to the ground, but, rather into the gutter.

Another object of the present invention is to provide a rain gutter cover with a low profile so that it is not visible from ground level.

Another object of the present invention is to provide a rain gutter cover which moves freely with the gutter in case of slight movement due to the weight of water in the gutter during a heavy downpour.

Another object of the present invention is to provide a rain gutter cover that attaches to the roof without the use of screws or nails.

Another object of the present invention is to provide a rain gutter cover which is inserted under the shingles of the roof so that only a small portion of the gutter cover is visible.

Another object of the present invention is to provide a rain gutter cover configured so that the top front lip of the rain gutter hides the mounting clip's attachment point and screws.

Another object of the present invention is to provide a rain gutter cover mounting clip configured to allow the cover to be used on several different styles of rain gutters.

Another object of the present invention is to provide a rain gutter cover with a smooth surface and rounded bottom edge and low profile to prevent leaves and debris from being transported into a gutter.

Another object of the present invention is to provide a rain gutter cover configured to prevent the gutter from clogging or damming with a subsequent build-up of debris and water on the roof.

Another object of the present invention is to provide mounting clips which are rotated into place when the mounting screw is screwed into place.

Another object of the present invention is to provide rain gutter covers which are maintenance free.

Another object of the present invention is to provide a rain gutter cover held in place with a reduced number of mounting clips to decrease the likelihood of debris getting caught on the mounting clips.

Another object of the present invention is to provide a clip and a rain gutter cover configured to allow the cover's curved edge to be compressed when it is mounted within the mounting clip.

Another object of the invention is to provide a rain gutter cover which is affixed in place by at least one fastener to prevent movement of the cover.

A rain gutter cover system embodying the invention includes a cover with a curled front edge which directs leaves and debris over the front edge of the gutter, but which directs water along the curled edge and into the gutter. Mounting clips are used to hold the cover in place over the gutter, and to ensure appropriate spacing between the top, front edge of the gutter and the curled front end of the cover. The mounting clips can be formed from a single flat piece of flexible sheet material. The mounting clips include a pair of jaws that surround and attach to the curled front edge of the cover, as well as a mounting portion configured to be attached to the top edge of the gutter with one or more fasteners. The mounting clip may also be configured to be easily grasped by a special pair of pliers to facilitate attaching the mounting clip to the gutter.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements, and wherein.

DETAILED DESCRIPTION OF PREFERRED EMBODIMENTS

A rain gutter cover system embodying the invention includes a solid sheet of metal or other water impervious material designed to protect rain gutters from leaves, pine needles, twigs, debris, birds and animals and the like. The cover is mounted directly over most or all of the gutter's top opening. The gutter is protected by the cover from leaves and pine needles including those which are blown around by the wind or those which fall straight down towards the gutter. For purposes herein, the terms "rain gutter cover," "gutter cover," and "cover" are used synonymously.

Figure 1:
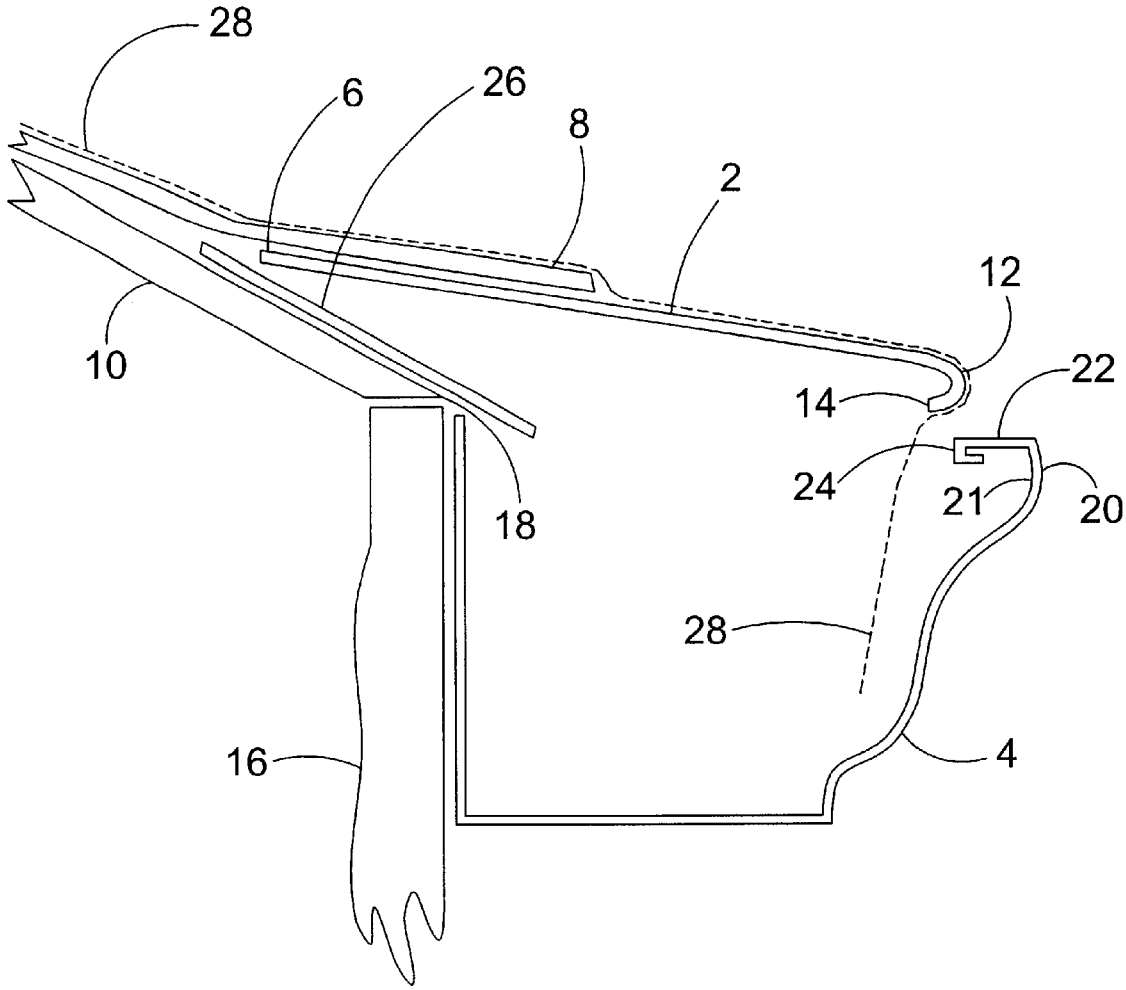
FIG. 1 is a cross section of a rain gutter with a rain gutter cover.

A cross section of the rain gutter, the rain gutter cover, and a roof is shown in FIG. 1. The rain gutter cover 2 is installed above the rain gutter 4 with the back edge 6 inserted beneath the lower edge of the roofing material 8 and resting upon the roof substrate 10. Opposite of the cover's back edge 6 is the cover's curved edge 12, with the cover's curved edge 12 terminating at the cover's bottom edge 14. The rain gutter 4 is attached to the fascia board 16 proximate to the roof's lower edge 18. Opposite of the fascia board 16, the gutter 4 has an upper front edge 20, and top front edge 22. The rain gutter's top front edge 22 terminates in the interior of the gutter 4 at the gutter's inside front edge 24. Lying between roof's substrate 10 and the rain gutter cover 2 is the starter shingle 26.

The cover's curved edge 12 is rounded like the letter "C" and has a diameter of preferably approximately 9/16" with an arc of approximately 180°. Other dimensions may also be appropriate, depending on the shape and size of the gutter and cover. The small diameter of the curved edge 12 allows the cover 2 to maintain a very low profile. Thus, the cover 2 is less obtrusive, since it is not noticeable when viewed from ground level.

Figure 2:
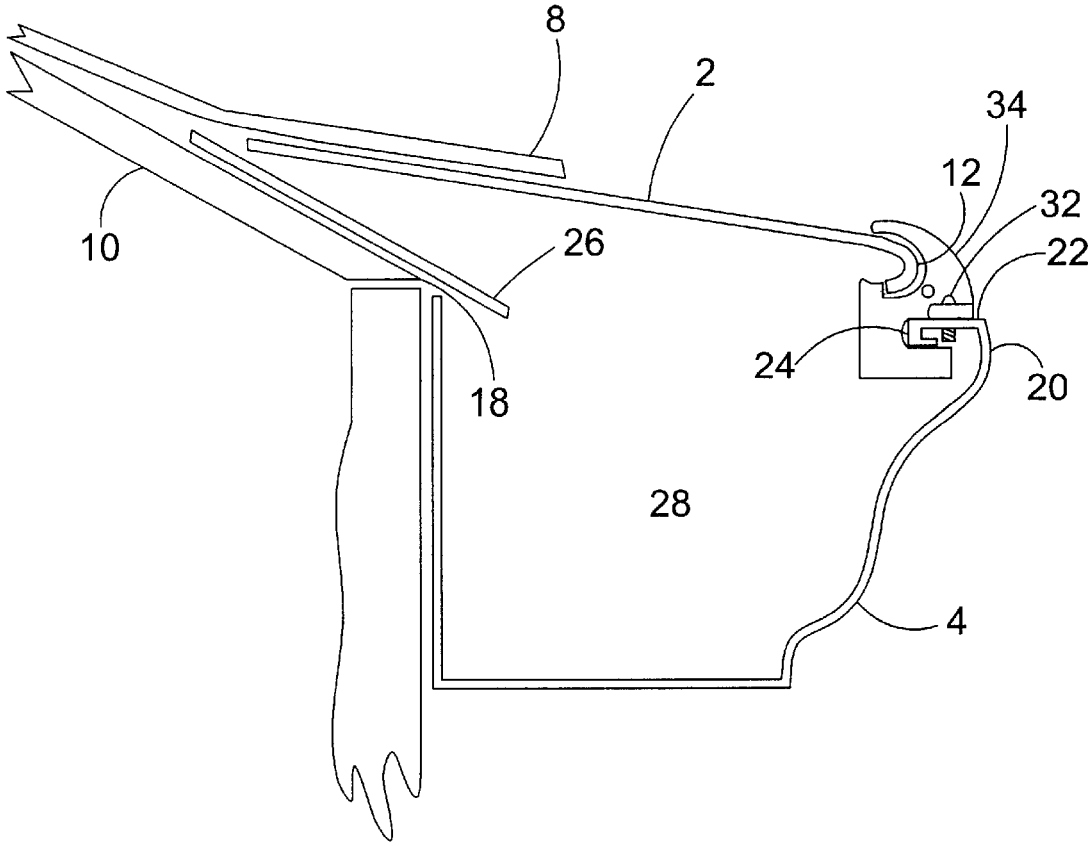
FIG. 2 is a cross section of a rain gutter with a rain gutter cover and mounting clip.

FIG. 2 shows the rain gutter 4 and the rain gutter cover 2 affixed to one another with a mounting clip 34. For purposes herein, the terms "mounting clip" and "clip" are used synonymously. The mounting clip 34 is held to the gutter's top front edge 22 by a screw or rivet 32 and is configured to engage the curved edge 12 of the cover 2. When properly installed, the top surface of the rain gutter cover is preferably approximately 5/8" above the top front edge 22 of the gutter.

Attaching the clip 34 on the top front edge 22 of the gutter 4 hides the clip's attachment point and any screws 32 used to attach the mounting clip 34 to the gutter. This prevents it from being seen from ground level, thereby improving the appearance of the gutter system.

The clip 34 allows the cover to be used on several different styles or kinds of gutters. The most common gutter designs are the "K" style commercial and residential gutters, half round gutters, square gutters and standard commercial gutters.

The rain gutter cover 2 extends down from a roof's lower edge 18 to cover substantially all of the gutter's entire opening. The term "entire opening" is used to mean the gutter cover's curved edge 12 extends past the inside front edge 24 of the gutter. However the cover 2 does not extend past the outer front edge 20 of the gutter. Thus, if any water does drip from the curved edge 12 of the cover, the water will not drop to the ground.

The dashed line 28 in FIG. 1 illustrates the path that run-off water will follow. The dashed line 28 starts on the roof and flows across the roofing material to cross the lower edge of the roofing material 8 and onto the rain gutter cover 2. The run-off water continues along the rain gutter cover 2 and follows the contour of the rain gutter cover's curved edge 12 to finally drip off at the cover's bottom edge 14 and fall into the rain gutter 4.

As shown in FIGS. 1 and 2, the cover's opposite flat straight edge 6 extends upwards past the lower edge of the roof 18 and comes to rest on the substrate 10 of the roof, under the first row of shingles or other roofing material 8. Alternatively, the cover may also extend up between the roofing material 8 and a starter shingle 26.

By placing the upper edge of the cover 2 under the first row of shingles or under the lower edge of other roofing material 8 only a small portion of the cover 2 is actually visible. With this arrangement, there is no danger of a roof leak caused by screwing or nailing the upper edge of the cover into the roof itself. The arrangement also allows the cover 2 to move freely with the gutter 4, relative to the roof, which can happen when the weight of water in the gutter 4 (such as during a heavy downpour) causes the gutter to move relative to the roof. If the cover 2 were rigidly attached to the roof, the repeated movement over time might weaken the mounting clips 34 which hold the gutter 4.

Figure 3:
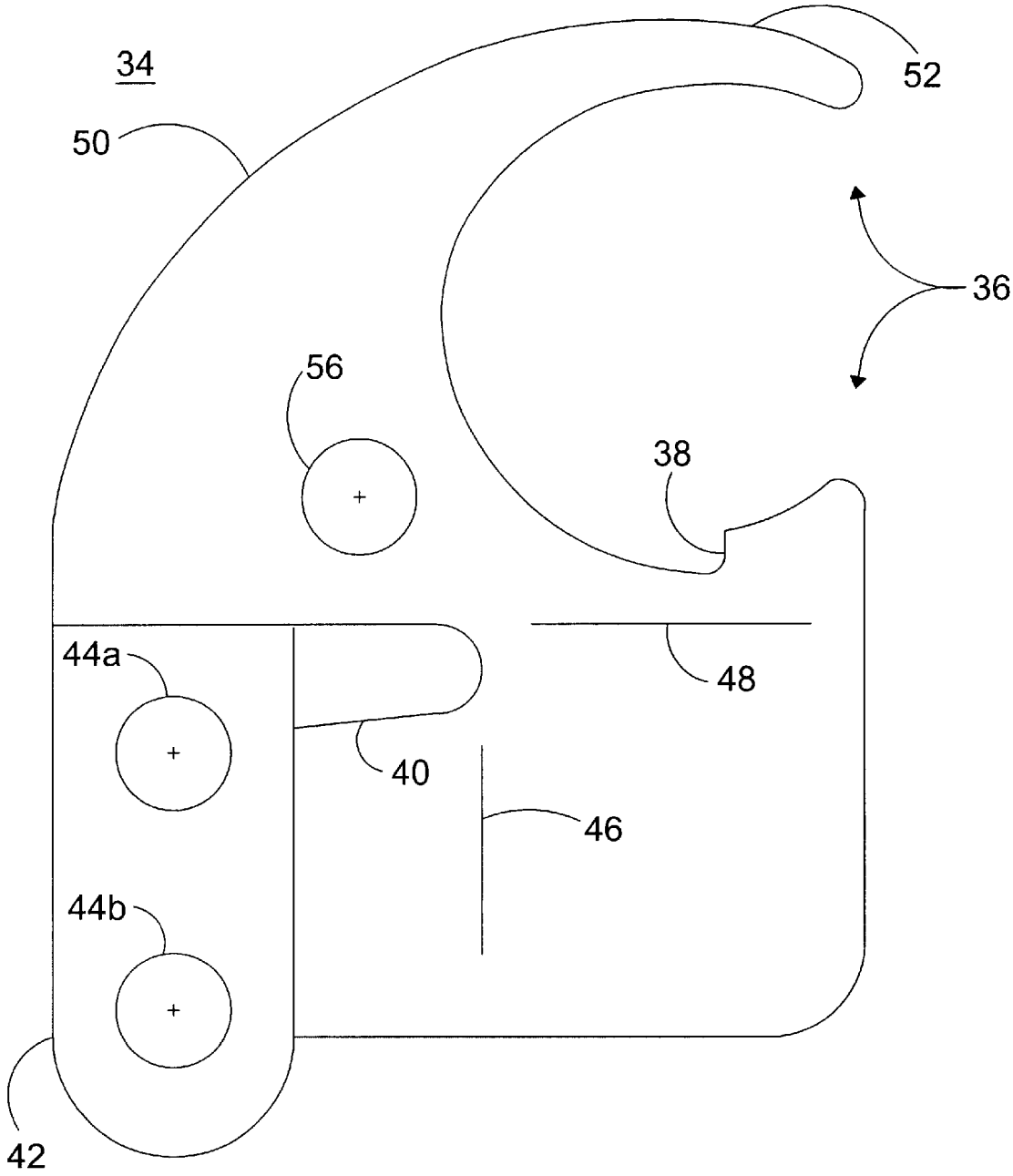
FIG. 3 shows a mounting clip embodying the invention.

A mounting clip 34 embodying the invention can be stamped or cut from a flat piece or sheet of water impervious material such as stainless steel, aluminum, copper, plastic, etc. for strength and longevity. As shown in FIG. 3, the mounting clip 34 has a "C" shaped opening 36 which breaks out along one edge of the mounting clip 34. The "C" shaped opening 36 has an inside curved edge 54. The inside curved edge 54 has a notch 38 at it's bottom portion. The mounting clip 34 has a hidden notch 40 which is near the center of the mounting clip 34. Adjacent to the hidden notch 40 is a lag 42. The lag 42 has two prepunched attachment holes 44*a*, 44*b*, and a score line along its base to facilitate bending the lag. The lower half of the mounting clip 34 has two score lines consisting of a vertical score line 46 and a horizontal score line 48. Along an outer edge of the mounting clip 34 opposite the inside curved edge is a vertical area 50. The vertical area 50 terminates adjacent to the "C" shaped opening 36 at the upper top curved edge 52. Disposed between the hidden notch 40 and the vertical area 50 is a hole 56.

The mounting clip's upper top curved edge 52 is tapered, and is configured to extend around and above the cover's curved edge 12. This taper prevents debris from catching on the mounting clip 34.

The "C" shaped opening 36 is where the cover's curved edge 12 is inserted to hold the cover 2 in position. The notch 38 serves to catch and stop the bottom edge 14 of the cover 2, thereby compressing and locking the curved edge 12 within the "C" shaped opening 36 of the mounting clip 34.

The hidden notch 40 helps hold the clip 34 firmly in place when installed on "K" style gutters. The clip 34 has two pre-punched attachment holes 44*a*, 44*b* on the lag 42. The lag 42 is bent at a ninety degree angle relative to the remainder of the clip 34 prior to installation. If looking at the clip 34, after mounting it on the gutter 4 and facing the front of the gutter 4, the lag 42 can be bent to the left or right side of the clip 34. Although the embodiment shown in FIG. 3 has two holes 44*a*, 44*b* in the lag, in other embodiments of the invention, there could be a single hole, or more than two holes.

The two score lines 46 and 48 are to allow bending or adjusting the body of the clip 34 as needed to mount the clip 34 on "K" style gutters, residential gutters, half round gutters, square gutters, commercial gutters, and other types of gutters. The score lines 46 and 48 and the pre-punched attachment holes 44*a*, 44*b* allow the clip 34 and the cover 2 to be installed on virtually any style of gutter. However, a mounting clip that is specifically made to be installed on one type of gutter may not need the score lines. Also, when the mounting clip is configured to be installed on a specific type of gutter, it may have a shape that differs from that shown in FIG. 3 to accommodate the shape of the gutter to which it will be attached.

Figure 11:
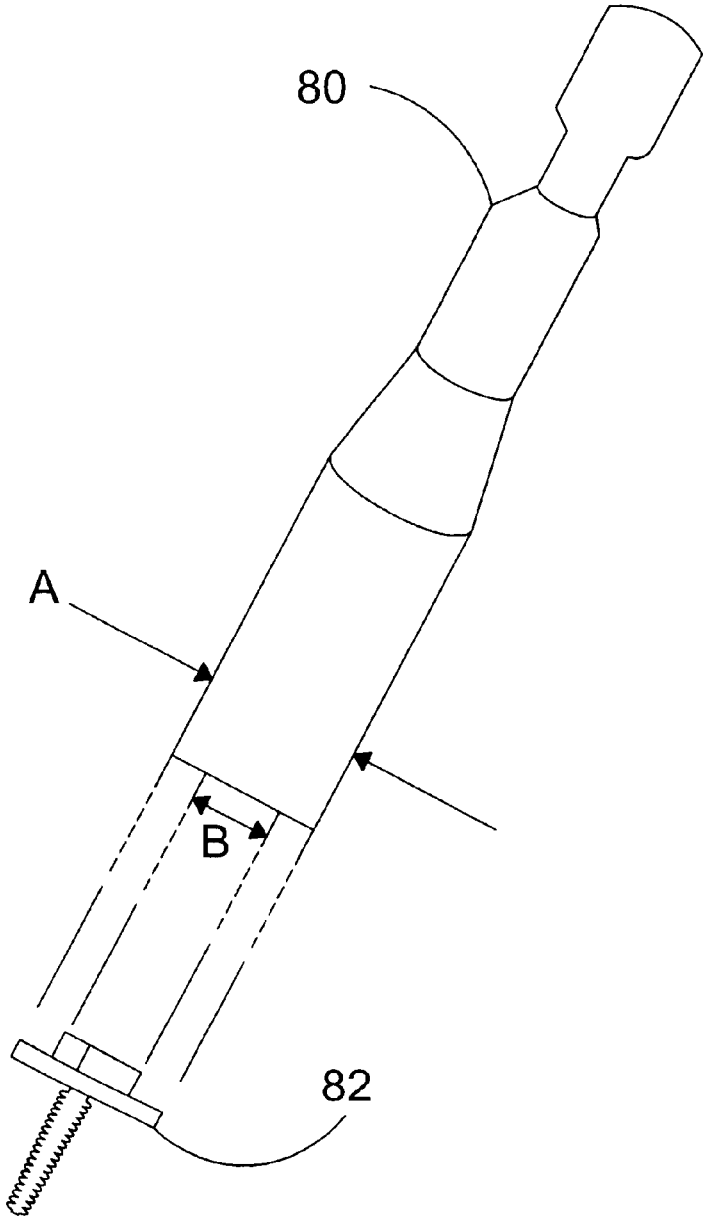
FIG. 11 shows a modified hex head nut driver.

A preferred embodiment of the invention includes a modified hex head nut driver, shown in FIG. 11, for installing hex head screws 82 in precisely placed punched holes 44*a* and 44*b* in the lag 42 of clip 34. The preferred outer diameter A of the hex nut driver is 5/16", and the preferred inner diameter B of the socket is ¼". The hex nut driver 80, is preferably configured for a number 6 hex head self-tapping screw 82.

The hex head self tapping screw which is held in place by the magnetic hex head screw driver can be driven by an electric drill or screwdriver. The use of a magnetic, hex head nut driver allows the installation process to proceed quickly by keeping the installation screws in place until they are fully inserted. The drawback to the use of a standard off-the-shelf nut driver is that its outmost diameter is larger than the outermost diameter of the hex head nuts outermost diameter. Therefore, a standard off the shelf hex head nut driver does not allow it to be used to insert the hex head screw of the clip 34 due to the clip's compact size. Instead, a magnetic hex head driver with extra thin walls is used. Without the precise spacing of the holes and the use of the extra thin walled magnetic head nut driver, the clip would need to be much larger. The larger size would detract from its appearance and cause the clip to catch debris. Neither of these drawbacks are desired.

Since the clip 34 is relatively small, the holes 44*a* and 44*b* are precisely placed. The holes 44*a* and 44*b* are placed as close together as possible and at the precise distance from the vertical edge of clip 34 so as to allow just enough space between the hex head screws outermost edges so that they do not touch each other or the vertical edge of clip 34 adjacent to the lag 42. The outer most edge of the screw's hex head must not touch each other and the outermost edge of the hex head screw placed in hole 44*a* next to the vertical edge of clip 34 must have sufficient space so that the nut's hex head outermost rim does not touch the clip's 34 vertical edge. If the outside walls of the hex head screw driver is larger than the outermost diameter of the outer most edge of the hex head screw, then as the screw is inserted the outside wall of the hex head screw driver will hit the adjacent screw head preventing the screw from being fully inserted or it will bend the vertical portion of clip 34 pushing it out of vertical alignment with the gutter. To prevent this from happening a hex head screwdriver has been designed with its outer most diameter not larger than the outermost diameter of the rim of the hex head screws being used. This modified hex head nut driver is incorporated as part of the installation process.

The result of the precise spacing of holes 44*a* and 44*b* in lag 42 and the use of this modified magnetic nut driver provides sufficient space for the hex head screws and hex head nut driver to fit into the compact space required for clip 34.

As shown in FIG. 2, the mounting clip 34 of FIG. 3 may be attached to the gutter top front edge 24 by use of screws, rivets or other fasteners 32 that pass through the holes 44*a*, 44*b* and into the top front edge 24 of the gutter. The hidden notch 40 in the mounting clip 34 can accommodate the inside front edge 24 of certain gutters, as also shown in FIG. 2. The fasteners 32 and hidden notch 40 in the clip 34 allow the clip and the covers 2 to be held firmly in place on the gutter 4. The clip's design provides a solid means of attaching the cover 2 to the gutter 4 and maintaining proper spacing between the cover and the gutter to ensure the cover's best performance.

To install sections of the rain gutter cover 2 on a roof where the roofing material 8 consists of shingles or tabs, the end of the first cover section has approximately one inch (1") of the curved edge 12 removed. The cover 2 is put into place by raising one of the shingles or tabs on the first row of shingles, and then inserting the upper corner of the untrimmed end of the cover 2 between the starter shingle 26 and first shingle or shingle tab which is raised. The cover 2 is then slid horizontally left or right under the next tab or shingle until the entire top edge of the cover 2 is under the first row of shingles and above the gutter 4 where it will be attached.

When working with standard dimensioned gutter stock, the cover pieces can be made into short lengths to facilitate shipping and handling and to allow easy alignment of warped gutters. Such dimensions are preferably in the range of lengths approximately four feet (4') long by seven inches (7") in width. For gutter stock which is warped, the use of these shorter pieces of gutter cover 2 along with mounting clips 34 helps in the realignment of the gutters outer front edge 20 for better performance and appearance. The covers can also be made on-site to virtually any dimension.

Figure 4A:
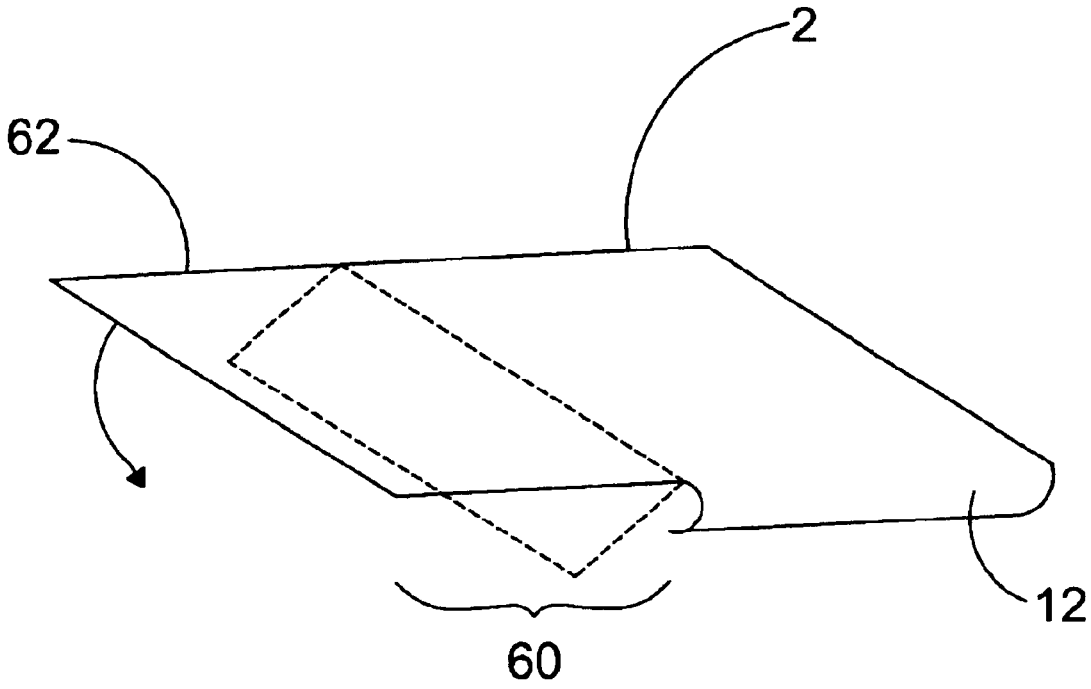
FIG. 4A illustrates how an end flap for a rain gutter cover can be formed.

Referring to FIG. 4A, the first and last piece of cover sections to be installed has approximately three inches 60 of it=s curved edge 12 removed from the end that will fit next to the gutters end caps. The tab 62 that remains after trimming is bent down at a 90E angle to the cover 2 and trimmed to form an end cap on the cover 2.

Figure 4B:
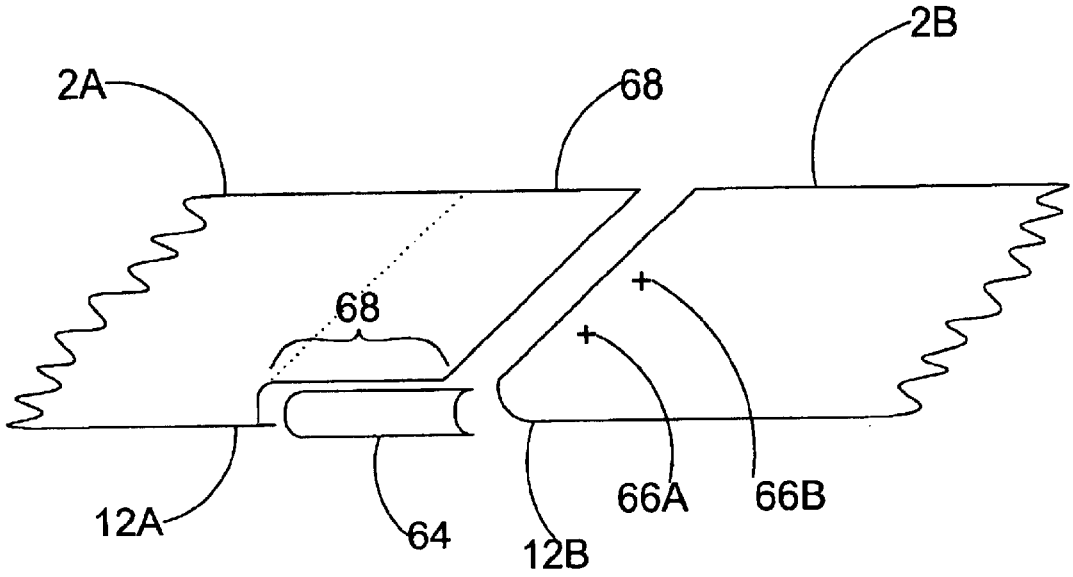
FIG. 4B illustrates how adjacent rain gutter covers can be joined together.

To join two adjacent sections of cover 2A, and 2B, as shown in FIG. 4B, an end of the first cover 2A has approximately one inch 64 of the curved edge 12A trimmed off leaving a tab 68. The tab 68 remaining after trimming the curved edge will serve as a platform to anchor the untrimmed end of an adjacent cover 2B with fasteners.

Starting with the first cover 2A in place, but before the final clip is attached thereto, the second cover 2B is put into position by raising a shingle on the first row of shingles then inserting a corner of the cover back edge 6 between the starter shingle 26 and first row of shingles 8. The second cover 2B remains un-trimmed. The second cover 2B is slid over the trimmed section 68 of the first cover 2A so that the curved edge 12A of the first cover 2A aligns with and butts against the curved edge 12B of the second cover 2B. The second cover 2B is then slid horizontally left or right under the next tab or shingle until the entire top edge of the second cover 2B is under the first row of shingles and above the gutter where it will be attached to the gutter=s top front edge.

After the second cover 2B is positioned so that it properly overlays the trimmed section 68 of the first cover 2A the first cover 2A receives its final mounting clip. This mounting clip is mounted to the curved edge 12A of first cover 2A approximately one inch from the tab 68. The next mounting clip is then mounted to the second cover 2B near the middle of cover 2B. Fasteners, such as self-tapping screws or rivets are then fixed in place through both covers 2A and 2B through the points 66A and 66B on the second cover 2B.

A certain amount of space must be maintained between the curved edge 12 of the cover 2 and the inside front edge 24 of the gutter. Otherwise there will not be sufficient space between the curved edge 12 and the gutter to allow water to follow the curved edge into the gutter 4. Attaching different sections of the cover material together as described above ensures that the curved edges 12 of the cover 2 butt together properly along the overlapping portions of the covers. By keeping the curved edge 12 as even as possible, the mounting clips 34 can be designed to maintain a minimum spacing between the curved edge 12 and the inside front edge 24 of the gutter 4, which helps to prevent debris from entering the gutter 4 through the gap.

Figure 8:
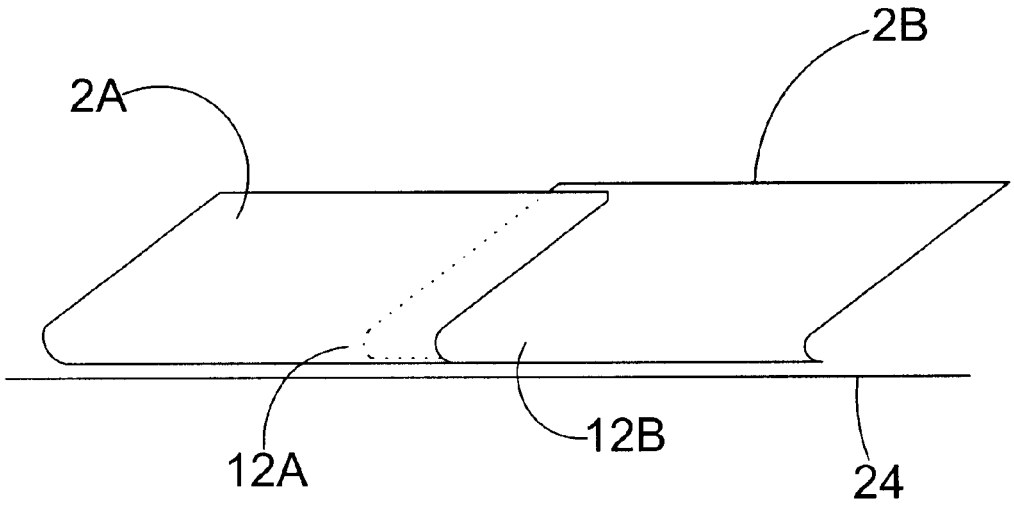
FIG. 8 shows overlapping rain gutter covers.

If different sections of the cover 2 were simply overlapped, there might not be enough space between the overlapping portions of the curved edge 12 and the gutter to allow water to pass into the gutter. For instance, as shown in FIG. 8, if adjacent covers 2A and 2B were simply overlapped without trimming the curved edge off one of the cover sections, there will be an uneven front edge at the overlapping section. The result would be poor or unacceptable performance due to the misalignment.

Figure 9:
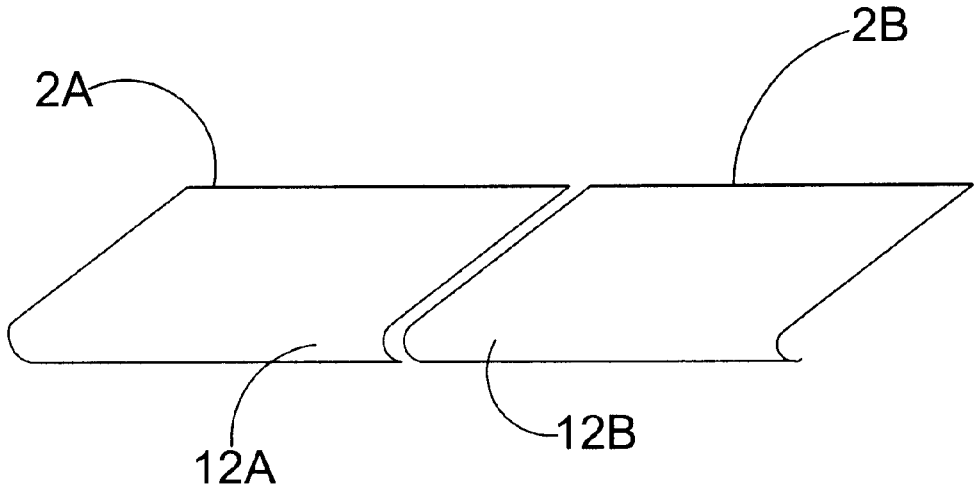
FIG. 9 shows butting two rain gutter covers together.

Similarly, butting two sections of covers 2A and 2B together as shown in FIG. 9, without overlapping them, could also result in poor alignment along the curved edges 12A and 12B, as well as the formation of gaps between the covers 2A and 2B. Expansion and contraction of the covers due to heat cycling can make the misalignment or gaps even worse than when the covers are originally installed.

Figures 5A, 5B:
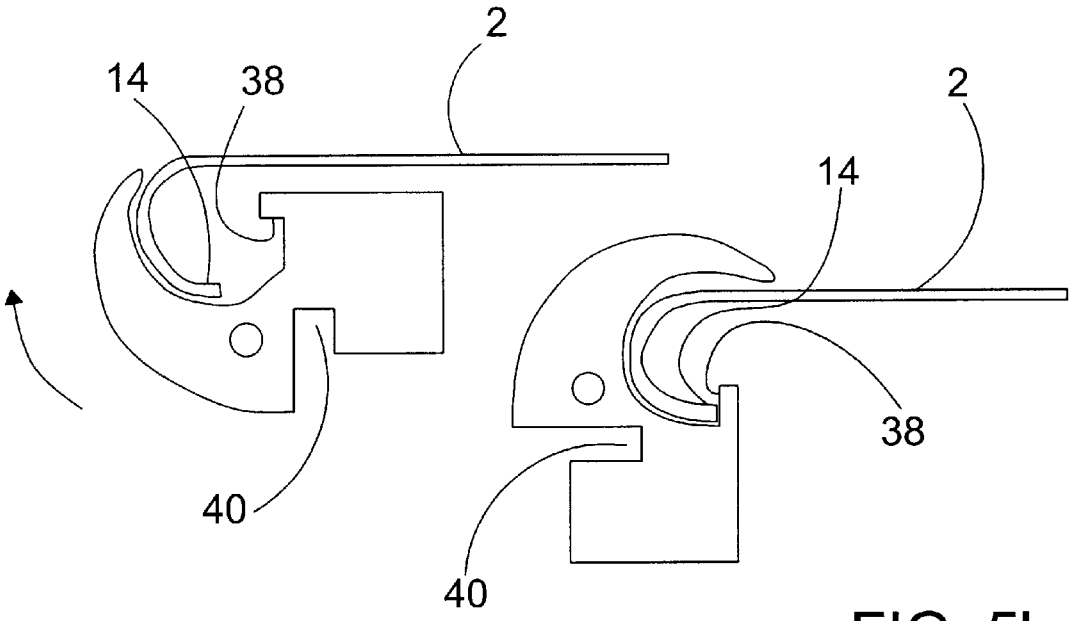
FIGS. 5A and 5B illustrate how a mounting clip embodying the invention is attached to rain gutter cover.

Referring to FIG. 5*a*, a mounting clip 34 is attached to the curved edge 12 of the cover 2 by manipulating the mounting clip 34 such that the curved edge 12 of the cover is inside the "C" shaped opening 36 of the mounting clip 34. The clip is then rotated, as shown in FIG. 5*b*, until the cover's bottom edge 14 contacts the notch 38. The notch 38 in the "C" shaped opening 36 causes the curved edge 12 of the cover 2 to compress inside the "C" shaped opening 36, as the clip 34 is rotated into the final position in which it will be mounted on the gutter 4. The benefit is that the clip 34 and the cover 2 are held tightly together due to the compressive force exerted by the cover's curved edge 12 against the inside the "C" shaped opening 36 and notch 38 of the of clip 34.

Figure 10:
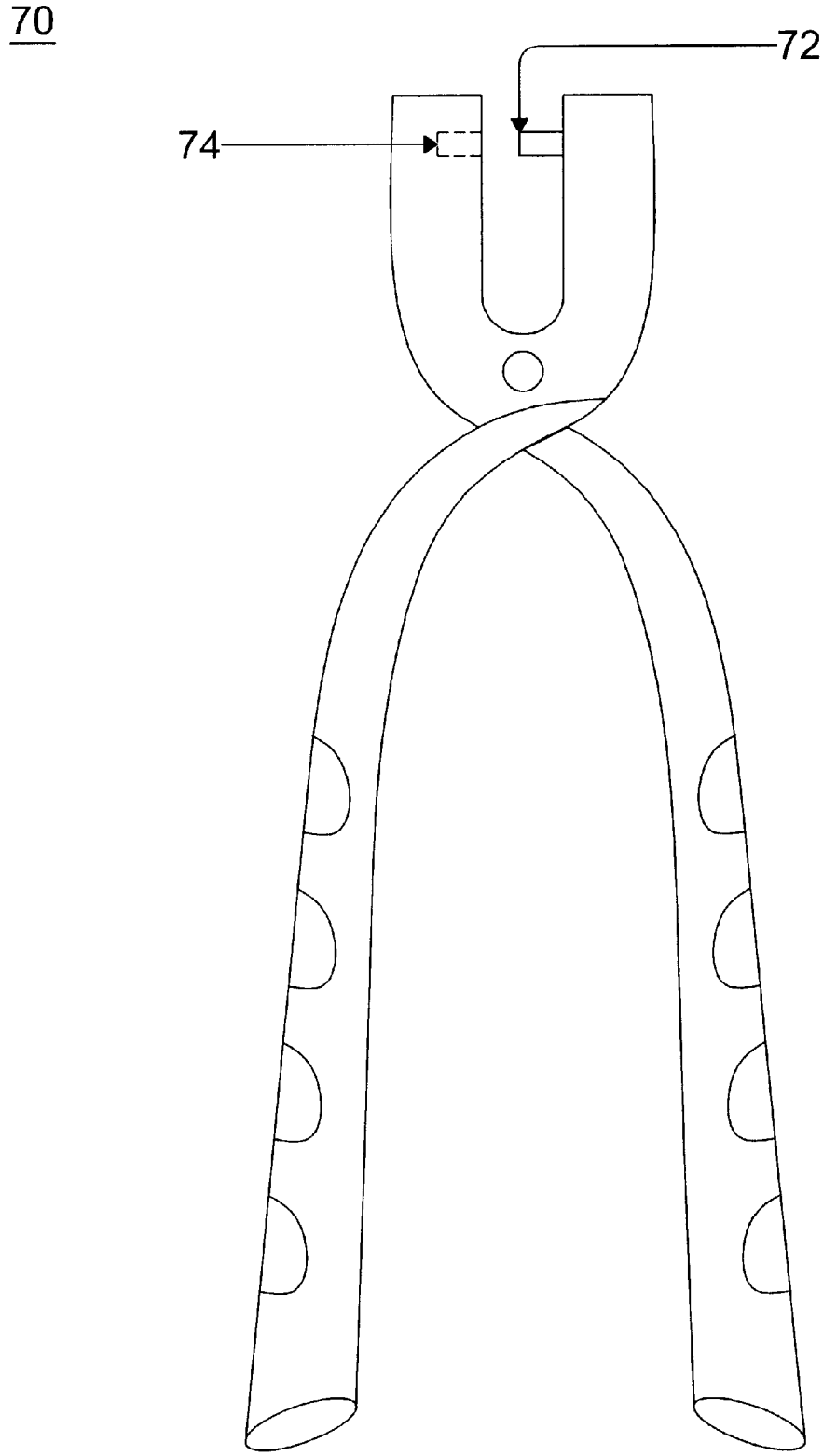
FIG. 10 shows installation pliers that can be used to install a mounting clip of a rain gutter cover embodying the invention.

After attaching the clip 34 to the cover 2, its lag 42 containing pre-punched attachment holes 44*a* and 44*b* comes to rest on the gutter's top front edge 22, as shown in FIG. 2. The clip 34 can be grasped by a special pliers device 70, as shown in FIG. 10, to facilitate attaching the clip 34 to the gutter 4. As shown in FIG. 10, the pliers have a small dowel 72 mounted on one of its jaws and a hole 74 in the opposite jaw configured to receive the dowel 72. The plier's jaws are placed onto the clip's front vertical surface, where the dowel 72 fits through the dowel pin hole 56 of the clip 34 and into the hole 74 in the opposite jaw of the pliers 70. By squeezing and pulling the pliers device, the clip 34 can be pulled into place and held firmly until the first fastener is inserted. The pliers 70 allows an installer to apply sufficient force to the clip 34 to pull the hidden notch 40 snugly over the gutters inside front edge 24 and top front edge 22 until the clip's back edge comes in contact with the gutter. The dowel 72 in the plier's jaws allows the installer to pull with sufficient force without fear of the pliers 70 slipping off the clip 34.

The fasteners, preferably self-starting screws, can be placed in pre-punched holes 44*a* and 44*b* in the lag 42, which has been bent at a 90° angle away from the remainder of the clip 34. The lag 42 sits flat on the gutter's top front edge 22. When the first self-starting screw 32 is inserted, the torque of the screw being rotated forces the clip 34 to torque tightly against the inside upper wall 21 of the gutter. If left handed threads were used the lag would be on the right in order to maintain this effect.

A second fastener is then inserted through the lag 42 and torqued into place. The benefit of the second fastener is to prevent the clip 34 from moving, which in turn keeps the clip 34 and cover 2 in place. The hidden notch 40 in the clip 34 fitted over the inside front gutter edge 24 serves to further stabilize the clip 34.

Additional clips 34 can then be installed by raising the free end of the cover 2 up just high enough to attach the clip 34 to the cover 2. The clip 34 is then attached to the cover 2 and the gutter 4 in a manner similar to the first clip. The location of the second clip 34 is preferably approximately fifteen inches from the first clip or about one half the distance to the opposite end of the cover 2, or in the middle of the cover 2. Another clip 34 is installed in a similar way preferably approximately one inch to two inches from the end at the opposite end of the cover 2. The clips are equally spaced, when practical, to give a uniform appearance to the overall installation.

It is important to maintain a proper spacing between the gutter's inside front edge 24 and the cover's curved edge 12. If there is too much space, debris will enter the gutter 4, if there is too little space, the rainwater flowing around the curved edge 12 will touch the gutter's edge and be will diverted outside the gutter 4. Installing the mounting clips 34 approximately fifteen inches apart will usually maintain the proper spacing between the gutter's top front edge 22 and the cover's curved edge 12.

Assuming each section of the cover material is approximately four feet long, the first piece of cover has three clips installed on it. One clip on each end, and one in the center. After the first piece of cover is installed all additional full pieces receive only two clips per cover, one in the middle and one on the end that is not already attached to an anchor or tab. This procedure is continued until the entire gutter is covered.

Figure 6:
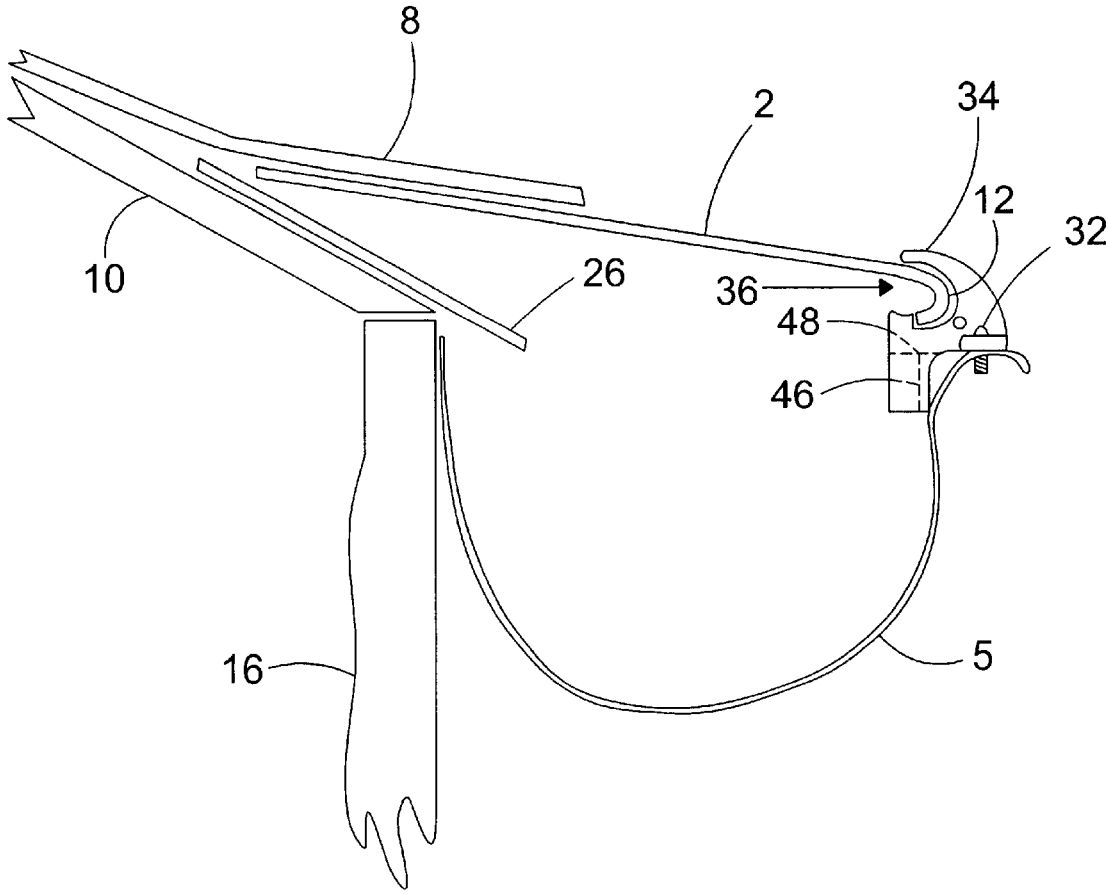
FIG. 6 shows rain gutter cover embodying the invention on a half-round rain gutter.

FIG. 6 shows the rain gutter cover installed onto a half-round gutter with the mounting clip. Referring to FIG. 6, the half-round rain gutter 5 has a half-round cross-section, and is attached to the fascia board 16. The gutter cover 2, similar to that shown in FIGS. 1 and 2, and resides below the shingles or roofing material 8 and above the roof substrate 10. A starter shingle 26 lies between the gutter cover and the roof substrate. The curved edge 12 of the gutter cover 2 slides into the "C" shaped opening 36 of the mounting clip 34, where it is held by compression. The mounting clip 34 is attached to the outer edge of the gutter with fasteners 32 such as a screw or rivet. To facilitate a solid connection between the mounting clip 34 and the half round gutter 5, the mounting clip 34 can be bent along either both or one of the vertical score line 46 or horizontal score line 48.

Figure 7:
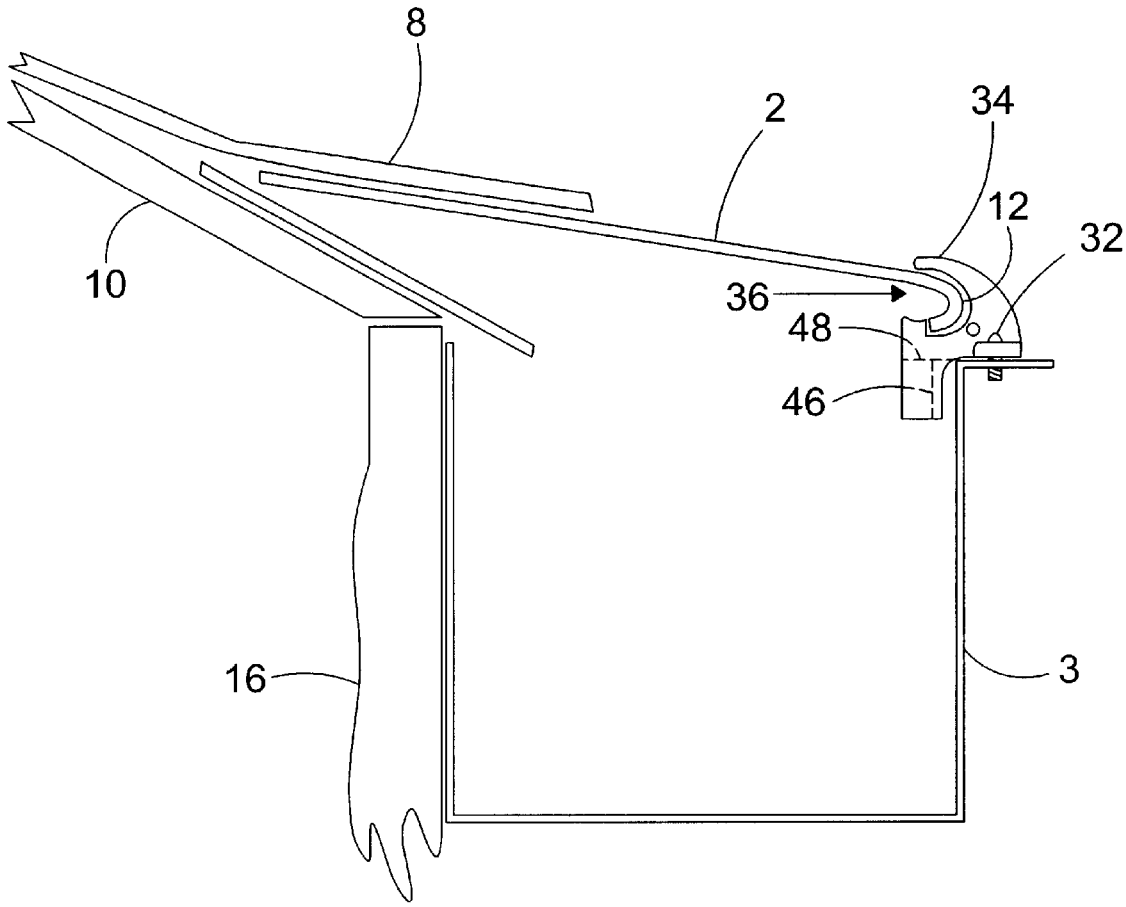
FIG. 7 shows a rain gutter cover embodying the invention on a commercial or square rain gutter.

Referring to FIG. 7, the gutter cover is shown installed on a commercial style rain gutter. In FIG. 7, the gutter cover 2 resides beneath the roof covering material 8 and above the roof substrate 10. The commercial rain gutter 3 is attached to the fascia board 16. The curved edge 12 of the gutter cover 2 is inserted into the "C" shaped opening 36 of the mounting clip 34, where it is held by compression. The mounting clip 34 is attached to the gutter 3 with fasteners 32 such as screws or rivets. To facilitate fastening the mounting clip 34 to the gutter 3, the clip 34 can be bent along either or both of the vertical score line 46 and/or the horizontal score line 48.

Gutter covers used on metal roofs pose an additional problem due to the water flow characteristics of the metal roofs versus shingled roofs. As rainwater flows down the surface of a metal roof, the water has the tendency to channel down toward the lowest edge of the roof since there is no irregularities in the surface to guide water flow as with shingles etc. Channeling causes the water to gather in larger amounts on the roof's low spots and travel faster than if it were slowed down by a textured surface as with asphalt shingles, wood etc. The channeling here refers to water as it gathers in streams. The streams of water cause a problem when the streams flow over the gutter cover. These streams continue to travel across the cover not having a chance to be evenly dispersed across the cover and slow down. In some cases the water cascades right over the edge of the cover without following the covers curved edge into the gutter.

One solution for metal roof installations is to coat the gutter cover with granules, such as roofing shingle granules. This would slow down the water and cause it to disperse over the cover. The granules either may be applied to the entire cover top and lower curved edge or they may extend down to the curved edge or approximately one inch above the curve on the top side of the cover.

A second solution to this problem is to place a strip of asphalt shingle with the granules facing upwards on top of the cover. The shingle's upper edge extends up under the metal roof's lower edge. The shingle's lower edge extends down toward the cover's curved edge, but stops approximately one inch from the curved edge. This allows adequate water dispersion, while the curved edge is not hampered from allowing water to flow naturally into the gutter. The strip can be secured by placing sheet metal screws through it into the cover below or by applying an adhesive such as silicone between the cover and the shingle strip.

When the rain gutter is properly installed, water adheres to and follows the surface and curved edge of the cover by the natural law of surface tension or adhesion as shown in FIG. 1 by the dashed line 28. As rainwater flows down and over the surface of the roof 8 and the cover 2, the water adheres to and follows the curved edge 12 around to its lower most point. At this point the water has already passed the inside front edge 24 of the gutter. The water is now inside the gutter. The continual downward flow of water guided by adhesion results in a natural flow of water around the curvature of the curved edge 12 into the gutter. The water then drops free from the lower most point of the curve 14 down into the gutter 4. Debris is not trapped by gutters, but instead is carried unimpeded over the cover's smooth surface and curved edge 12 to fall to the ground. Thus, the gutters do not clog and debris buildup on the roof is prevented.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A rain gutter cover mounting clip, comprising:

a flat body;

a "C" shaped opening configured to receive a curled edge of a rain gutter cover, wherein said a "C" shaped opening breaks out along a first edge of said flat body;

a notch in an edge of said opening;

a lag disposed at a corner of said flat body, the lag being bent at approximately a ninety degree angle to said flat body; and at least one hole in said flat body configured to receive a fastener.

2. The mounting clip of claim 1, wherein said a "C" shaped opening is further configured to compress the curled edge of the rain gutter cover and said notch is configured to butt against a bottom edge of the rain gutter cover.

3. The mounting clip of claim 1, wherein said flat body comprises a rigid, water impermeable material.

4. The mounting clip of claim 1, wherein said at least one hole is located in said lag.

5. The mounting clip of claim 1, further comprising a notch configured to engage an edge of a rain gutter.

6. The mounting clip of claim 1, further comprising at least one score line in said flat body configured to allow a portion of said flat body to preferentially bend in a certain direction.

7. The mounting clip of claim 6, wherein said at least one score line is horizontal.

8. The mounting clip of claim 6, wherein said at least one score line is vertical.

9. The mounting clip of claim 6, wherein said at least one score line comprises a first score line and a second score line, and wherein said first score line is at a right angle to said second score line.

10. The mounting clip of claim 1, further comprising a dowel pin hole configured to receive a dowel pin to aid in gripping said mounting clip.

11. A rain gutter cover system designed to be used to cover a gutter mounted on the periphery of a roof covered with roofing material, wherein said gutter has a first side affixed to said roof and a second side extending away from said roof, the cover system comprising:

a gutter cover disposed above said gutter with a first edge mounted beneath the roofing material, and a curled edge disposed proximate to said second side of said gutter; and a mounting clip attached to said second side of said gutter and attached to said curled edge of said gutter cover, wherein said mounting clip comprises:

a flat body;

a "C" shaped opening which breaks Out along a first edge of said flat body and having a curve that receives said curled edge of said gutter cover; and a notch in said "C" shaped opening.

12. The rain gutter cover system of claim 11, wherein said "C" shaped opening compresses the curled edge of the gutter cover and said notch butts against a bottom edge of the gutter cover.

13. The rain gutter cover system of claim 11, wherein said mounting clip comprises a rigid, water impermeable material.

14. The rain gutter cover system of claim 11, wherein said mounting clip further comprises a lag bent at approximately a ninety degree angle to said flat body, and wherein said lag comprises at least one hole that receives a fastener.

15. The rain gutter cover system of claim 11, wherein said mounting clip is attached to said second side of said gutter with at least one fastener.

16. The rain gutter cover system of claim 15, wherein said at least one fastener is a self-tapping screw.

17. The rain gutter cover system of claim 11, wherein said mounting clip further comprises a notch that receives an inwardly projecting portion of said second side of said rain gutter.

18. The rain gutter cover system of claim 11, wherein said mounting clip further comprises at least one score line in said flat body that allows a portion of said flat body to preferentially bend in a certain direction.

19. The rain gutter cover system of claim 18, wherein said at least one score line comprises a first score line and a second score line, wherein said first score line is at a right angle to said second score line.

20. The rain gutter system of claim 11, wherein said mounting clip further comprises a dowel pin hole that receives a dowel pin to aid in gripping said mounting clip.

21. A method of attaching a gutter cover to a rain gutter, comprising;

placing a curled edge of a gutter cover into a "C" shaped opening of a mounting clip, wherein the "C" shaped opening in the mounting clip includes a notch;

rotating the mounting clip such that the curled edge of the gutter cover engages the notch in the "C" shaped opening of the mounting clip; and fastening the mounting clip to an edge of the rain gutter with at least one fastener that passes through the mounting clip and into the gutter.

22. The method of claim 21, wherein fastening the mounting clip to an edge of the rain gutter comprises engaging a notch on the mounting clip with an edge of the rain gutter.

23. The method of claim 21, wherein fastening the mounting clip to an edge of the rain gutter comprises bending a lag of the mounting clip along a score line in the mounting clip.

24. The method of claim 21, wherein fastening the mounting clip to an edge of the rain gutter comprises:

bending a lag of the mounting clip such that the lag is parallel to a first surface of the rain gutter; and fastening the lag to the first surface of the rain gutter.

* * * * *